US009200828B2

(12) United States Patent
Mitchell et al.

(10) Patent No.: US 9,200,828 B2
(45) Date of Patent: Dec. 1, 2015

(54) REFRIGERATOR

(75) Inventors: Alan Joseph Mitchell, Louisville, KY (US); Brent Alden Junge, Evansville, IN (US)

(73) Assignee: General Electric Company, Schenectady, NY (US)

( * ) Notice: Subject to any disclaimer, the term of this patent is extended or adjusted under 35 U.S.C. 154(b) by 1094 days.

(21) Appl. No.: 12/268,090

(22) Filed: Nov. 10, 2008

(65) Prior Publication Data

US 2010/0115985 A1 May 13, 2010

(51) Int. Cl.

| | |
|---|---|
| ***F25D 17/04*** | (2006.01) |
| ***F25D 17/06*** | (2006.01) |
| ***F25C 5/00*** | (2006.01) |
| *F25D 21/08* | (2006.01) |

(52) U.S. Cl.

CPC ..... *F25D 17/065* (2013.01); *F25C 5/005* (2013.01); *F25D 21/08* (2013.01)

(58) Field of Classification Search

CPC ... F25C 2100/10; F25D 19/006; F25D 23/12; F25D 11/025; F25D 17/065; F25D 21/08

USPC ..... 62/407, 405, 413, 426

See application file for complete search history.

(56) References Cited

U.S. PATENT DOCUMENTS

| | | | |
|---|---|---|---|
| 3,433,300 | A | 3/1969 | Pasternak |
| 3,568,465 | A | 3/1971 | Jung |
| 4,300,359 | A | 11/1981 | Koeneman et al. |
| 4,424,683 | A | 1/1984 | Manson |
| 4,665,708 | A | 5/1987 | Tate, Jr. et al. |
| 4,719,765 | A | 1/1988 | Hooper et al. |
| 4,739,233 | A | 4/1988 | Marcade |
| 4,741,169 | A | 5/1988 | Linstromberg |
| 4,751,825 | A | 6/1988 | Voorhis et al. |
| 4,754,615 | A | 7/1988 | Linstromberg |
| 4,756,165 | A | 7/1988 | Chestnut et al. |
| 4,787,216 | A | 11/1988 | Chesnut et al. |
| 4,799,362 | A | 1/1989 | Chestnut |

(Continued)

FOREIGN PATENT DOCUMENTS

| | | |
|---|---|---|
| GB | 1493746 | 11/1977 |
| JP | 11-294928 A | 10/1999 |

(Continued)

OTHER PUBLICATIONS

English translation of JP 11294928.*

(Continued)

*Primary Examiner* — Jonathan Bradford
*Assistant Examiner* — Elizabeth Martin
(74) *Attorney, Agent, or Firm* — Dority & Manning, P.A.

(57) ABSTRACT

A refrigerator includes a main body defining a compartment, the compartment having an access opening, a first wall and a heat exchanger supported by the first wall; a refrigeration system containing therein a working medium and including an evaporator which is disposed outside of the compartment for cooling the compartment; a door supported by the main body for selectively closing at least part of the access opening of the compartment; and a sub-compartment on the door and including a second wall with an opening. The heat exchanger is coolable by the working medium. The heat exchanger and the second wall are positioned so that when the door is in a closed position, the heat exchanger is exposed to an interior of the sub-compartment through the opening.

31 Claims, 12 Drawing Sheets

(56) References Cited

U.S. PATENT DOCUMENTS

| | | | | |
|---|---|---|---|---|
| 4,800,935 | A | 1/1989 | Buchser et al. | |
| 4,833,894 | A | 5/1989 | Chesnut | |
| 4,942,979 | A | 7/1990 | Linstromberg et al. | |
| 4,997,109 | A | 3/1991 | Carper | |
| 5,033,273 | A | 7/1991 | Buchser et al. | |
| 5,050,777 | A | 9/1991 | Buchser | |
| 5,077,985 | A | 1/1992 | Buchser et al. | |
| D324,869 | S | 3/1992 | Carper | |
| 5,117,654 | A | 6/1992 | Steffenhagen | |
| 5,139,183 | A | 8/1992 | Buchser et al. | |
| 5,160,094 | A | 11/1992 | Willis et al. | |
| 5,187,948 | A | 2/1993 | Frohbieter | |
| 5,203,399 | A * | 4/1993 | Koizumi | F25B 23/006 165/104.22 |
| 5,269,154 | A | 12/1993 | Schmidt | |
| 5,272,888 | A | 12/1993 | Fisher et al. | |
| 5,297,394 | A | 3/1994 | Frohbieter et al. | |
| 5,329,786 | A | 7/1994 | Willis et al. | |
| 5,946,939 | A * | 9/1999 | Matsushima et al. | 62/507 |
| 6,050,097 | A | 4/2000 | Nelson et al. | |
| 6,082,130 | A | 7/2000 | Pastryk et al. | |
| 6,125,641 | A | 10/2000 | Kim et al. | |
| 6,148,624 | A | 11/2000 | Bishop et al. | |
| 6,161,390 | A | 12/2000 | Kim | |
| 6,242,714 | B1 | 6/2001 | Narumiya et al. | |
| D447,493 | S | 9/2001 | Shelley et al. | |
| 6,286,324 | B1 | 9/2001 | Pastryk et al. | |
| 6,314,745 | B1 | 11/2001 | Janke et al. | |
| 6,351,955 | B1 | 3/2002 | Oltman et al. | |
| 6,397,618 | B1 | 6/2002 | Chu et al. | |
| 6,401,478 | B2 | 6/2002 | Dasher et al. | |
| 6,425,259 | B2 | 7/2002 | Nelson et al. | |
| 6,481,235 | B2 | 11/2002 | Kwon | |
| 6,484,529 | B2 | 11/2002 | Dasher et al. | |
| 6,532,751 | B1 | 3/2003 | Schenk et al. | |
| 6,539,742 | B2 | 4/2003 | Mitchell et al. | |
| 6,571,567 | B2 | 6/2003 | An et al. | |
| 6,588,227 | B2 | 7/2003 | Kim et al. | |
| 6,637,217 | B2 | 10/2003 | Kim et al. | |
| 6,674,642 | B1 | 1/2004 | Chu et al. | |
| 6,705,091 | B1 | 3/2004 | Kim et al. | |
| 6,725,680 | B1 | 4/2004 | Schenk et al. | |
| 6,725,685 | B2 | 4/2004 | Kang | |
| 6,789,614 | B2 * | 9/2004 | Sin et al. | 165/151 |
| 6,804,974 | B1 | 10/2004 | Voglewede et al. | |
| 6,823,689 | B2 | 11/2004 | Kim et al. | |
| 6,857,279 | B2 | 2/2005 | Kim et al. | |
| 6,901,764 | B2 | 6/2005 | An et al. | |
| 6,904,765 | B2 | 6/2005 | Lee et al. | |
| 6,910,526 | B1 | 6/2005 | Sokolean | |
| 7,017,354 | B2 | 3/2006 | Lee et al. | |
| 7,017,363 | B2 | 3/2006 | Lee et al. | |
| 7,017,364 | B2 | 3/2006 | Lee et al. | |
| 7,040,111 | B2 | 5/2006 | Lee et al. | |
| 7,080,518 | B2 | 7/2006 | Kim et al. | |
| 7,111,473 | B2 | 9/2006 | Chung et al. | |
| 7,124,602 | B2 | 10/2006 | Lee et al. | |
| 7,131,280 | B2 | 11/2006 | Voglewede et al. | |
| 7,134,292 | B2 | 11/2006 | Oh | |
| 7,185,507 | B2 | 3/2007 | Maglinger et al. | |
| 7,188,479 | B2 | 3/2007 | Anselmino et al. | |
| 7,210,299 | B2 | 5/2007 | Yang | |
| 7,210,307 | B2 | 5/2007 | Kuehl et a | |
| 7,213,638 | B2 | 5/2007 | Seiler et al. | |
| 7,219,509 | B2 | 5/2007 | Pastryk et al. | |
| 7,222,497 | B2 | 5/2007 | An et al. | |
| 7,228,702 | B2 | 6/2007 | Maglinger et al. | |
| 7,228,703 | B2 | 6/2007 | Kim et al. | |
| 7,237,393 | B2 | 7/2007 | Chung et al. | |
| 7,240,512 | B2 * | 7/2007 | Lee et al. | 62/353 |
| 7,257,962 | B2 | 8/2007 | Son | |
| 7,263,854 | B2 | 9/2007 | Lee et al. | |
| 7,266,890 | B2 | 9/2007 | Cieslik et al. | |
| 7,266,951 | B2 | 9/2007 | Anselmino et al. | |
| 7,266,972 | B2 | 9/2007 | Anselmino et al. | |
| 7,272,949 | B2 * | 9/2007 | Lee et al. | 62/344 |
| 7,278,275 | B2 | 10/2007 | Voglewede et al. | |
| 7,278,277 | B2 | 10/2007 | Son | |
| 7,284,390 | B2 | 10/2007 | Van Meter et al. | |
| 7,318,323 | B2 | 1/2008 | Tatsui et al. | |
| 7,607,312 | B2 | 10/2009 | Wetekamp et al. | |
| 7,614,244 | B2 * | 11/2009 | Venkatakrishnan et al. | 62/187 |
| 7,703,299 | B2 | 4/2010 | Schlosser et al. | |
| 7,721,561 | B2 | 5/2010 | Kim | |
| 2006/0086128 | A1 | 4/2006 | Maglinger et al. | |
| 2006/0086132 | A1 | 4/2006 | Maglinger et al. | |
| 2006/0108109 | A1 | 5/2006 | Romero-Beltran | |
| 2007/0074527 | A1 * | 4/2007 | Lee et al. | 62/344 |
| 2007/0119193 | A1 | 5/2007 | Davis et al. | |
| 2008/0127670 | A1 | 6/2008 | Tikhonov et al. | |
| 2008/0156009 | A1 | 7/2008 | Cur et al. | |
| 2008/0307823 | A1 * | 12/2008 | Lee et al. | 62/441 |
| 2009/0260371 | A1 | 10/2009 | Kuehl et al. | |
| 2009/0293501 | A1 * | 12/2009 | Kulkarni et al. | 62/3.63 |

FOREIGN PATENT DOCUMENTS

| | | | | |
|---|---|---|---|---|
| JP | 11294928 | A * | 10/1999 | F25D 3/00 |
| WO | WO 2006067378 | A1 * | 6/2006 | |

OTHER PUBLICATIONS

Office action issued in connection with related U.S. Appl. No. 12/796,776 dated Mar. 21, 2014.

Office action issued in connection with related case U.S. Appl. No. 12/796,776 dated Aug. 14, 2014.

Office action issued in connection with related U.S. Appl. No. 12/877,131 dated Apr. 10, 2014.

* cited by examiner

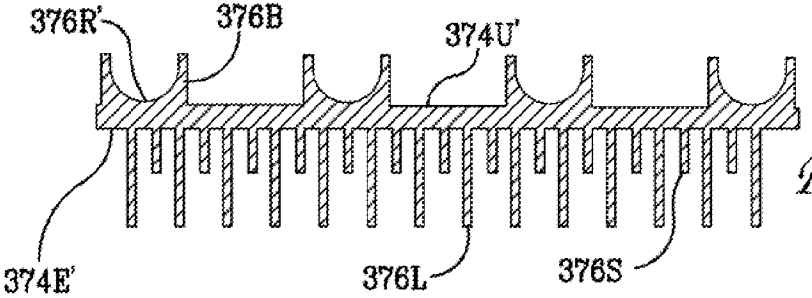
FIG. 11
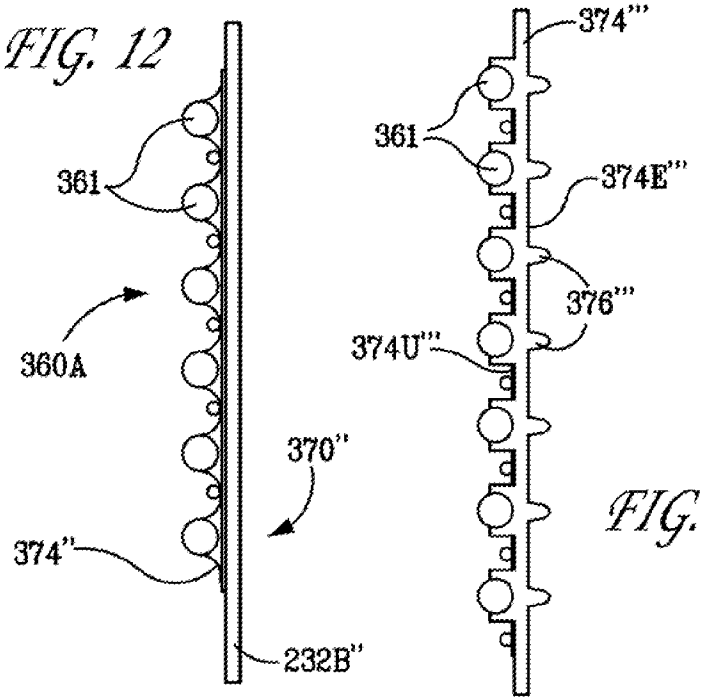
FIG. 12
FIG. 13
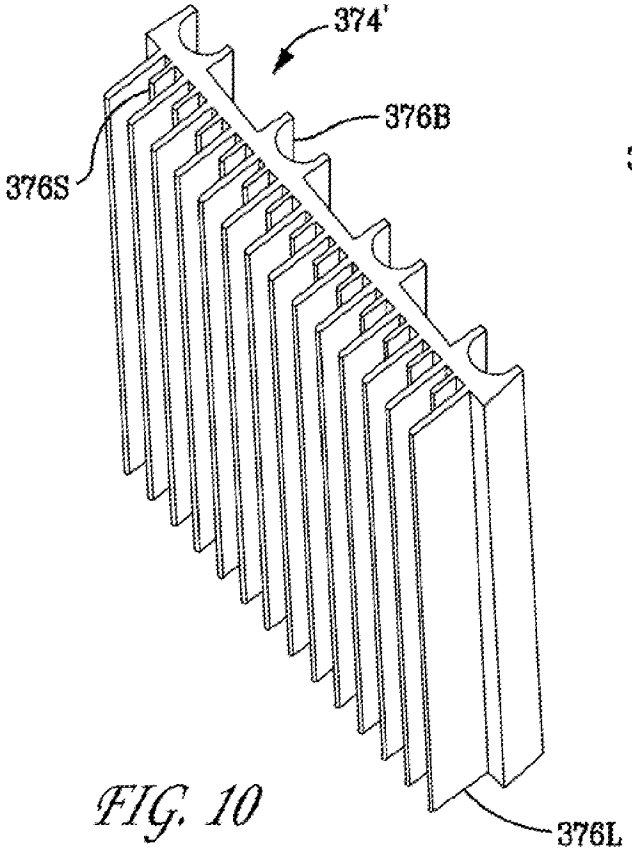
FIG. 10

REFRIGERATOR

BACKGROUND OF THE INVENTION

The present invention relates generally to a refrigerator. More particularly, the present invention relates to a "bottom freezer" type refrigerator having a sub-compartment on the door for the top mounted fresh food compartment.

Generally, a refrigerator includes a freezer compartment and a fresh food compartment which are partitioned from each other to store various foods at low temperatures in appropriate states for a relatively long time.

It is now common practice in the art of refrigerators to provide an automatic icemaker. In a "side-by-side" type refrigerator where the freezer compartment is arranged to the side of the fresh food compartment, the icemaker is usually disposed in the freezer compartment, and ice is delivered through an opening on the door for the freezer compartment. In this arrangement, ice is formed by freezing water with cold air in the freezer compartment, the air being made cold by the refrigeration system of the refrigerator, which includes an evaporator disposed in the freezer compartment.

In a "bottom freezer" type refrigerator where the freezer compartment is arranged below or beneath a top mounted fresh food compartment, convenience necessitates that the icemaker is disposed in a thermally insulated sub-compartment mounted on the door for the top mounted fresh food compartment, and ice is delivered through an opening on the door for the fresh food compartment. In such an arrangement provision must be made for providing adequate cooling to the sub-compartment to enable the icemaker to form ice and for the ice to be stored.

In one approach, the cold air in the freezer compartment is used to cool the icemaker. More specifically, the cold air in the freezer compartment, preferably the cold air around the evaporator in the freezer compartment, is circulated through the sub-compartment via a duct loop to maintain the icemaker in the sub-compartment at a temperature below the freezing point of water during operation. In this arrangement, a substantial portion of the duct loop is embedded in the insulation material of the sidewall of the main body of the refrigerator. The duct itself needs to have a sufficiently large cross-section to ensure that a sufficient amount of cold air can be delivered to and from the sub-compartment. However, the duct sometimes adversely reduces the thickness of the insulation material so that multiple heaters are needed in order to prevent the formation of condensation on the external surface of the main body. Using the heaters increases the energy consumption of the refrigerator. In addition, both the heaters and the duct loop increase the manufacturing cost.

In another approach, a liquid coolant in the nature of a mixture of propylene glycol and water is used to cool the icemaker. The liquid coolant is cooled by the cold air in the freezer compartment, and then is circulated to and from the icemaker in the sub-compartment through a circulation loop by a pump. The circulation loop needs to be liquid-tight. This is especially true with respect to the section of the circulation loop that extends between the main body of the refrigerator and the sub-compartment on the door for the fresh food compartment. This approach provides good cooling results, but it complicates the maintenance and/or repair process when the door for the fresh food compartment needs to be removed from the main body of the refrigerator.

In either approach, the working medium, be it chilled air or a liquid coolant, has to be delivered into, and removed from the sub-compartment.

BRIEF DESCRIPTION OF THE INVENTION

As described herein, the exemplary embodiments of the present invention overcome one or more of the above or other disadvantages known in the art.

One aspect of the present invention relates to a refrigerator including a main body defining a compartment, the compartment having an access opening, a first wall and a heat exchanger supported by the first wall; a refrigeration system containing therein a working medium and an evaporator for cooling the compartment which is disposed outside of the compartment; a door supported by the main body for selectively closing at least part of the access opening of the compartment; and a sub-compartment on the door and including a second wall with an opening. The heat exchanger is coolable by the working medium. The heat exchanger and the second wall are positioned so that when the door is in a closed position, the heat exchanger is exposed to an interior of the sub-compartment through the opening.

Another aspect of the present invention relates to a refrigerator including a main body defining a first compartment and a second compartment, the first compartment having an access opening, a first wall and a heat exchanger supported by the first sidewall; a refrigeration system containing therein a working medium and including an evaporator for cooling the first compartment and the second compartment, which is disposed in the second compartment; a door supported by the main body for selectively closing at least part of the access opening of the first compartment; and a sub-compartment on the door, the sub-compartment having a second wall having an opening. The heat exchanger is coolable by the working medium. And the heat exchanger and the second wall are positioned so that when the door is in a closed position, the heat exchanger is exposed to an interior of the sub-compartment through the opening.

Yet another aspect of the present invention relates to a refrigerator including a main body defining an upper compartment and a lower compartment, the upper compartment having a frontal access, a first sidewall and a heat-exchanging plate supported by the first sidewall; a refrigeration system containing therein a working medium and including an evaporator which is disposed in the lower compartment for cooling the upper and lower compartments; a pair of doors supported by the main body for selectively closing the frontal access of the upper compartment; and a sub-compartment on one of the doors and substantially disposed in the upper compartment when the one of the doors is in a closed position, the sub-compartment including a second sidewall having an opening. The heat exchanging plate is coolable by the working medium. The heat-exchanging plate and the second sidewall are positioned so that when the one of the doors is in the closed position, the heat-exchanging plate is exposed to an interior of the sub-compartment through the opening.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

BRIEF DESCRIPTION OF THE DRAWINGS

In the drawings:

FIG. 10 is a perspective view of a heat exchanger in accordance with a second exemplary embodiment of the invention;

FIG. 11 is an enlarged cross-sectional view of the heat exchanger of FIG. 10;

FIG. 12 shows a heat exchanger in accordance with a third exemplary embodiment of the invention;

FIG. 13 shows a heat exchanger in accordance with a fourth exemplary embodiment of the invention;

DETAILED DESCRIPTION OF THE EXEMPLARY EMBODIMENTS OF THE INVENTION

Figure 1:
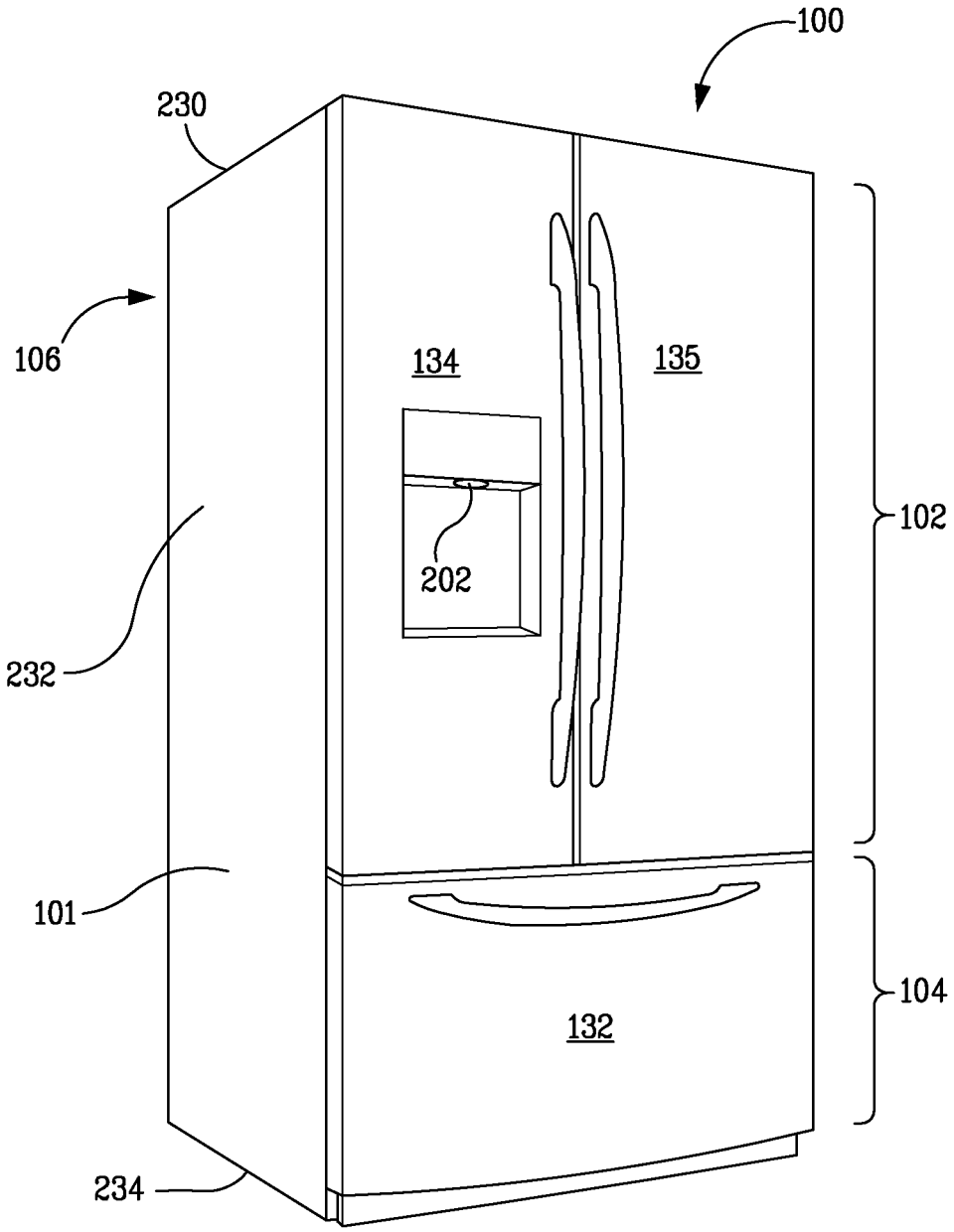
FIG. 1 is a perspective view of a refrigerator in accordance with an exemplary embodiment of the invention.
Figure 2:
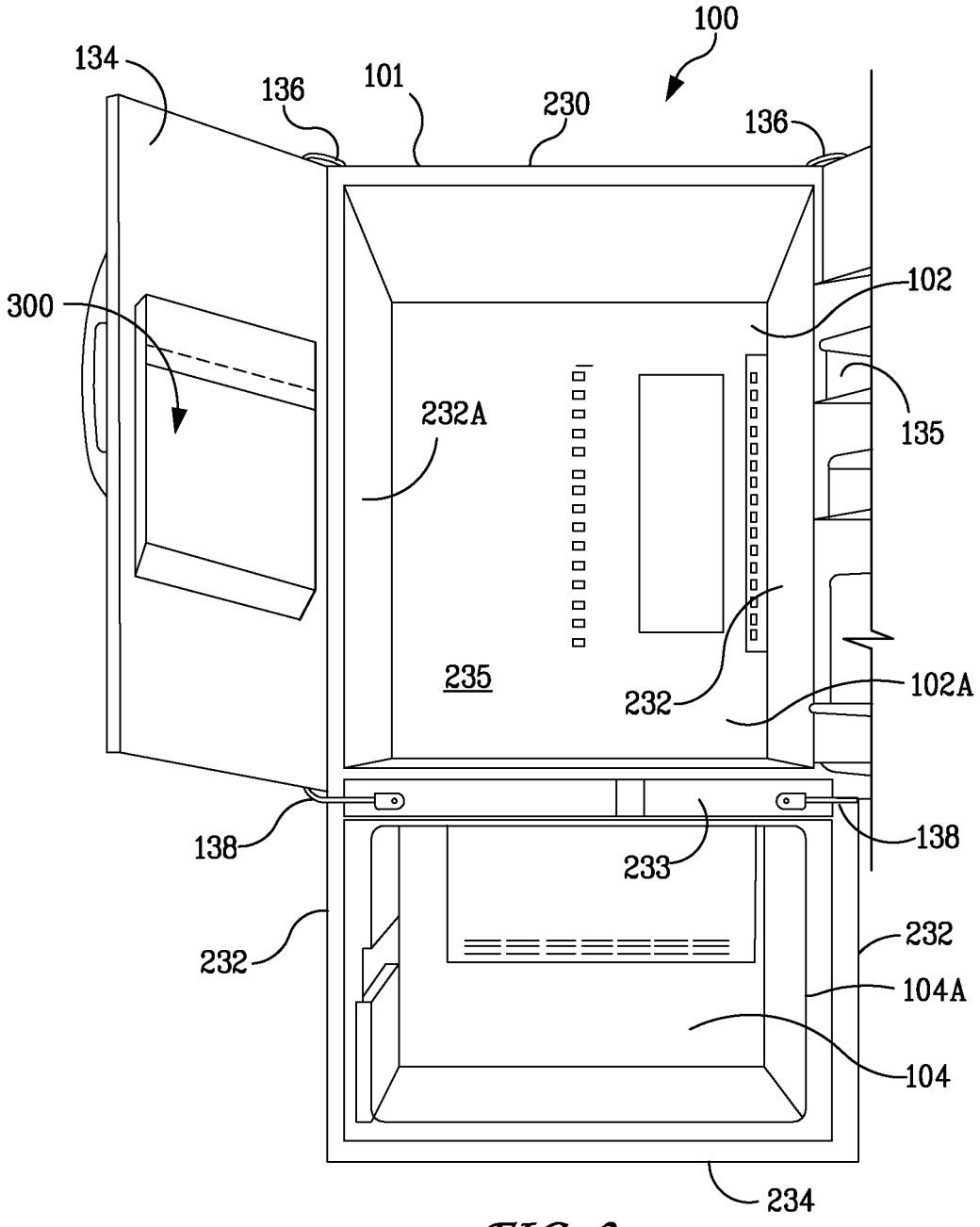
FIG. 2 is a perspective view of the refrigerator of FIG. 1 with the doors for the fresh food compartment being open and with the drawer/door for the freezer compartment being removed.

Referring now to FIGS. 1 and 2, a refrigerator in accordance with an exemplary embodiment of the invention is generally designated by reference numeral 100. The refrigerator 100 has a main body 101 which defines therein a first, upper, fresh food compartment 102 with a frontal access opening 102A and a second, lower, freezer compartment 104 with a frontal access opening 104A. The fresh food compartment 102 and the freezer compartment 104 are arranged in a bottom mount configuration where the fresh food compartment 102 is disposed or positioned above the freezer compartment 104. The fresh food compartment 102 is shown with two French doors 134 and 135. However, a single door can be used instead of the doors 134, 135. The freezer compartment 104 can be closed by a drawer or a door 132.

The main body 101 of the refrigerator 100 includes a top wall 230 and two sidewalls 232. The top wall 230 connects the sidewalls 232 to each other at the top ends thereof. A mullion 233, best shown in FIG. 2, connects the two sidewalls 232 to each other and separates the fresh food compartment 102 from the freezer compartment 104. The main body 101 also includes a bottom wall 234, which connects the two sidewalls 232 to each other at the bottom ends thereof, and a back wall 235. As is known in the art, at least each of the sidewalls 232 includes an outer case 232A, a liner 232B, and a thermal insulation layer 232C disposed between the outer case 232A and the liner 232B (see FIG. 7). The thermal insulation layer 232C is made of a thermal insulation material such as a rigid polyurethane or other thermoset foam.

The drawer/door 132 and the doors 134, 135 close the frontal access openings 104A, 102A, respectively.

Each of the doors 134, 135 is mounted to the main body 101 by a top hinge 136 and a bottom hinge 138, thereby being rotatable approximately around the outer vertical edge of the fresh food compartment 102 between an open position for accessing the respective part of the fresh food compartment 102, as shown in FIG. 2, and a closed position for closing the respective part of the fresh food compartment 102, as shown in FIG. 1.

Similarly, when an access door 132 is used for the freezer compartment 104, it is rotatably attached to the main body 101 in a similar fashion. When a drawer is used for the freezer compartment 104, it is slidably received in the interior or cavity defined by the freezer compartment 104 in a known fashion.

Figure 3:
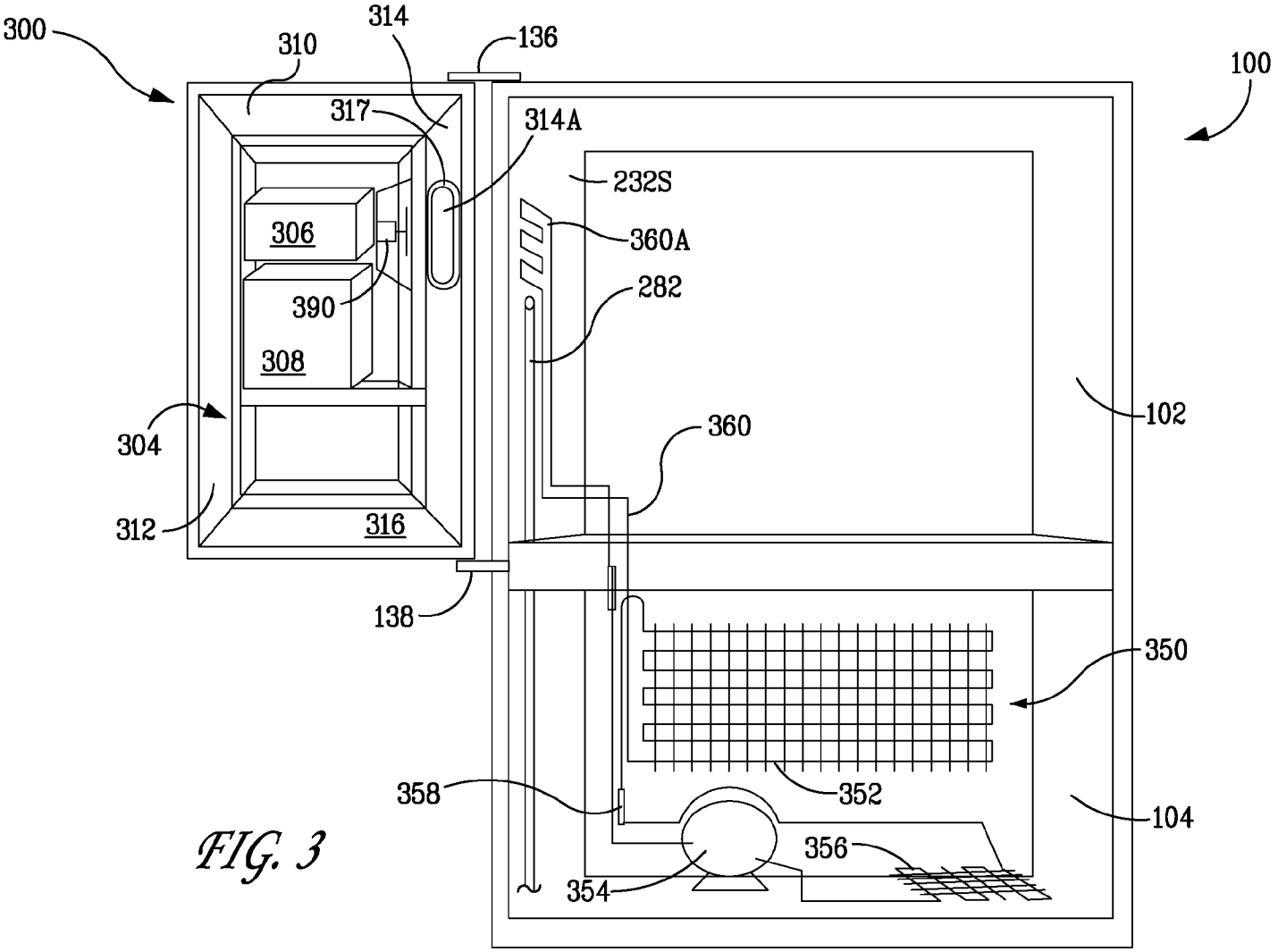
FIG. 3 partially and schematically shows some of the components of the refrigerator of FIG. 1, with one fresh food compartment door open and the other being removed and the door for the sub-compartment and the drawer/door for the freezer compartment being removed.
Figure 4:
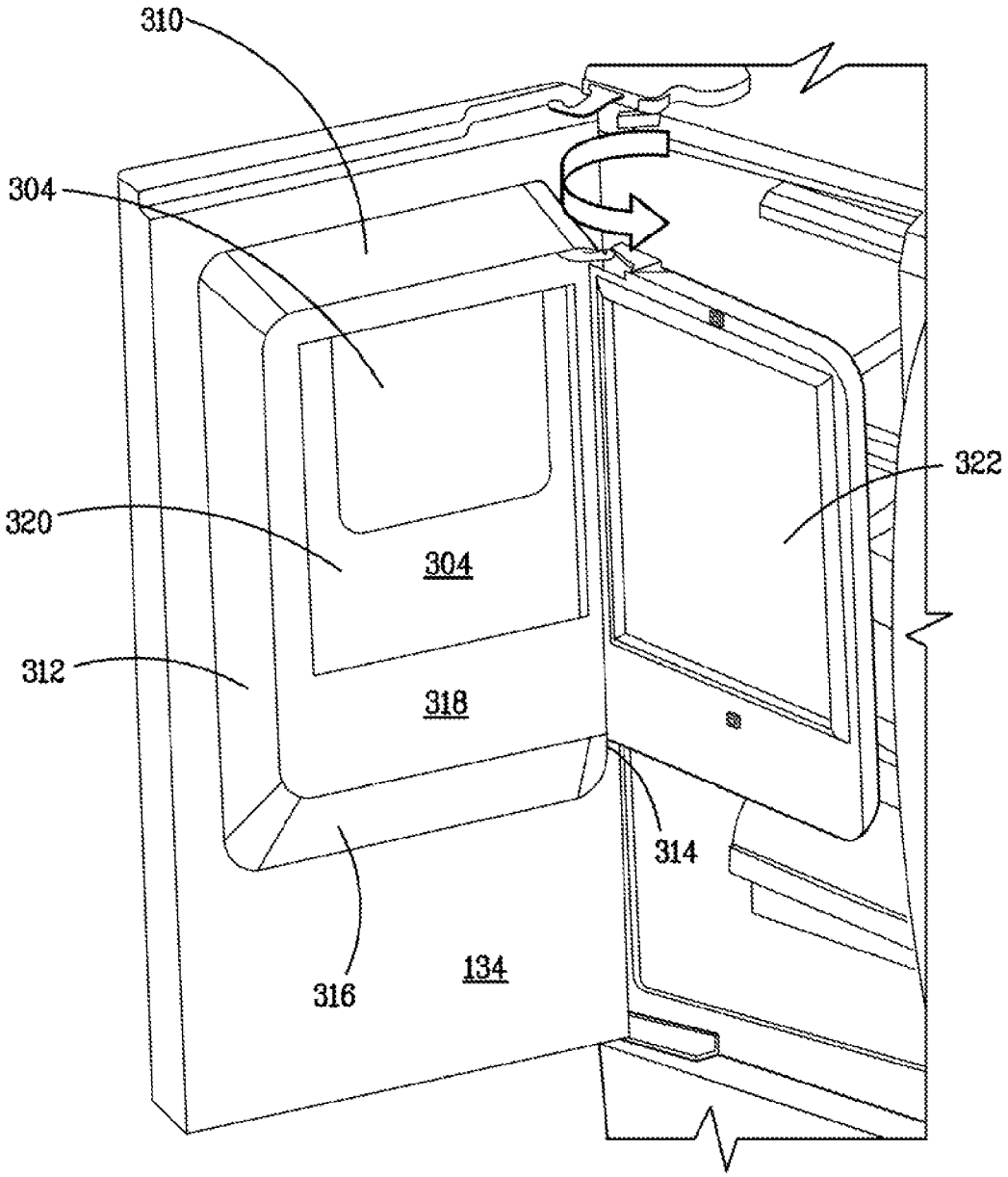
FIG. 4 is a perspective, partial view of a fresh food compartment door of the refrigerator of FIG. 2.

As shown in FIGS. 2-4, an ice-making section 300 for freezing water and selectively discharging ice is mounted on the door 134 for the fresh food compartment 102. The ice-making section 300 is disposed substantially in the fresh food compartment 102 when the door 134 is the closed position. The ice-making section 300 delivers ice through a chute formed in the door 134. The chute extends downward and/or outward from the ice-making section 300, with its lower end 202 being accessible from the exterior surface side of the door 134 (see FIG. 1). The lower end 202 is preferably positioned at a height facilitating convenient access to the ice. Of course, the ice-making section 300 can be mounted on the door 135 instead.

As illustrated in FIGS. 1-5, the ice-making section 300 includes an ice sub-compartment 304 mounted on or partially formed by the liner of the door 134, an icemaker 306 disposed in the sub-compartment 304, and preferably an ice storage bin 308 disposed in the sub-compartment 304 and below or underneath the icemaker 306. Since the fresh food compartment 102 normally has a temperature higher than the freezing point of water, the sub-compartment 304 is preferably thermally insulated to prevent or substantially reduce the undesired heat transfer between air in the sub-compartment 304 and the air in the fresh food compartment 102. The sub-compartment 304 has a top wall 310, two sidewalls 312, 314, a bottom wall 316, a front wall 318, and a back wall that can be formed by the inner liner of the door 134. Preferably, the front wall 318 has an opening 320, and an access door 322 is pivotably or rotatably mounted to the front wall 318 in a known fashion for selectively closing the opening 320. To facilitate cooling the ice sub-compartment 304, the sidewall 314, which faces the sidewall 232S of the fresh food compartment 102 when the door 134 is closed, has an opening 314A. A gasket 317 is attached to the sidewall 314 and surrounds the opening 314A. The function of the opening 314A and the gasket 317 will be discussed in detail below.

As is known in the art, water is delivered to one or more ice molds (not shown) of the icemaker 306 through a water supply conduit (not shown) and then frozen into ice cubes. After frozen, the ice cubes may be discharged from the ice molds and stored in the ice storage bin 308 until needed by a user. The ice cubes may be withdrawn by accessing the ice storage bin 308 through the access door 322. The ice cubes, however, are typically dispensed via the chute by an ice-dispensing device (not shown) installed in the door 134.

Referring now to FIG. 3, the refrigeration system 350 of the refrigerator 100 is preferably a single evaporator system. The sealed system includes evaporator 352 disposed in the freezer compartment 104, a compressor 354 disposed downstream of the evaporator 352 and outside of the freezer compartment 104, a condenser 356 disposed downstream of the compressor 354, an expansion valve 358 disposed downstream of the condenser 356, and a fluid connection loop 360 fluidly connecting these elements 352-358 together. The refrigeration system 350 contains therein a working medium (i.e., the refrigerant). Unlike known refrigerators, however, the fluid connection loop 360, which fluidly connects the evaporator 352 to the compressor 354 for transmitting the refrigerant therebetween, includes a serpentine portion 360A (i.e., the cooling serpentine) disposed or embedded in the sidewall 232S of the fresh food compartment 102 at a location proximate the opening 314A in door 134 when the door 134 is closed. By this arrangement, the serpentine portion 360A can be used to cool the ice sub-compartment 304 as hereinafter described.

As shown in FIGS. 1-7 and/or as should be apparent from the discussion, the liner 232B of the sidewall 232S of the fresh food compartment 102 has an opening 372 that preferably faces or is substantially aligned with the opening 314A of the sidewall 314 of the sub-compartment 304 when the door 134 is in the closed position. In one embodiment, a heat exchanger 370, comprising a formed metal heat-exchanging plate 374, is attached to the liner 232B and covers the opening 372. The heat exchanger 370 is thermally coupled to the serpentine portion 360A so that the refrigerant, when passing through the serpentine portion 360A, cools the heat exchanger 370. As best illustrated in FIGS. 1-7 and/or as should be apparent from discussion, when the door 134 is closed, the heat-exchanging plate 374 is substantially aligned with the opening 314A, the gasket 317 touches/presses the sidewall 232S and surrounds the heat-exchanging plate 374 so that the heat-exchanging plate 374 is exposed to the interior of the sub-compartment 304 while the gasket 317 substantially seals the heat-exchanging plate 374 and the interior of the sub-compartment 304 from the rest of the fresh food compartment 102. In other words, when the door 134 is closed, part of the sidewall 232S including the heat-exchanging plate 374, the gasket 317 and the sub-compartment 304 form or define a substantially sealed interior space.

Figure 5:
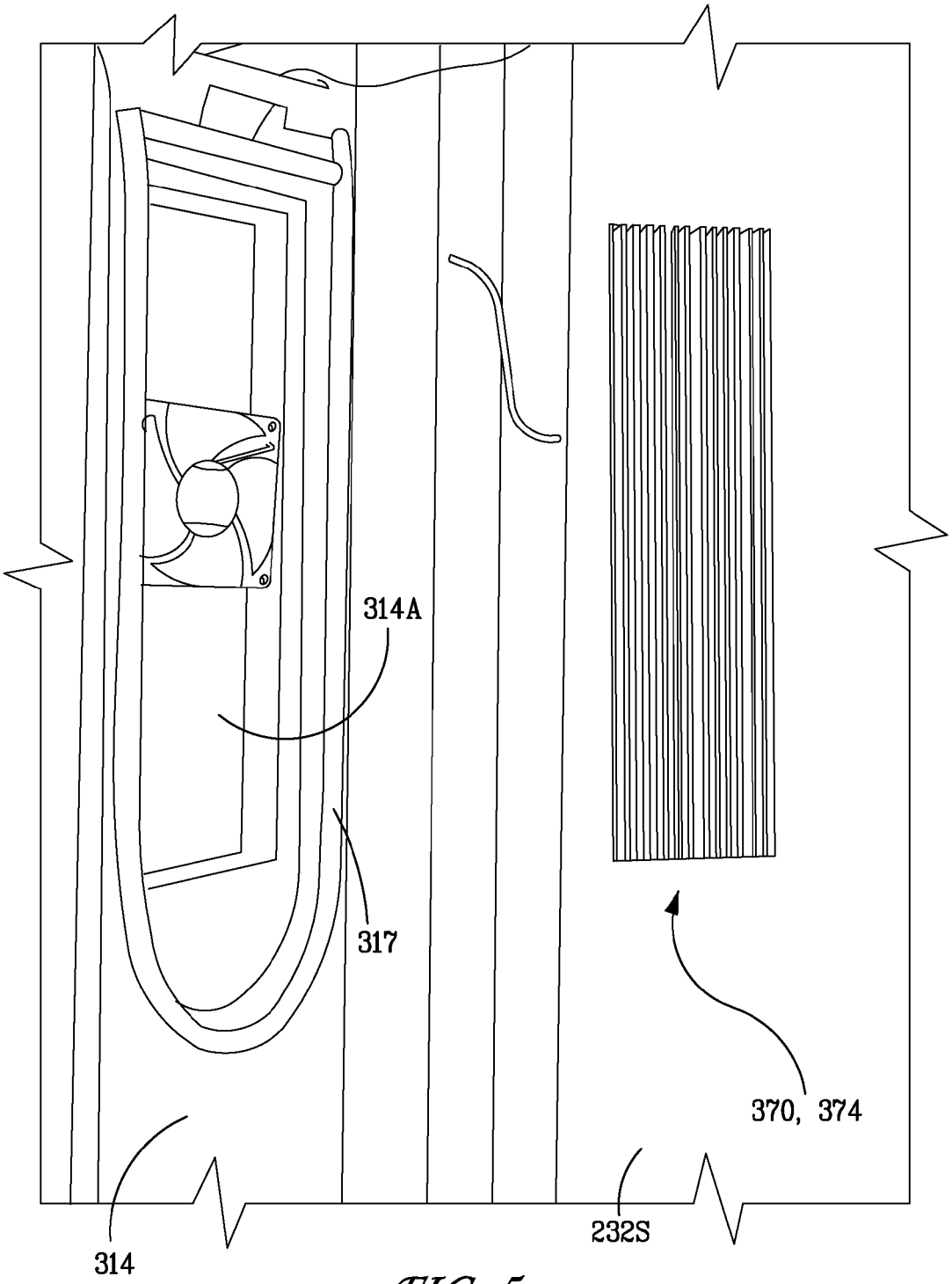
FIG. 5 is an enlarged, perspective view of the opening of the sub-compartment and the heat exchanger of the refrigerator of FIG. 2.
Figure 6:
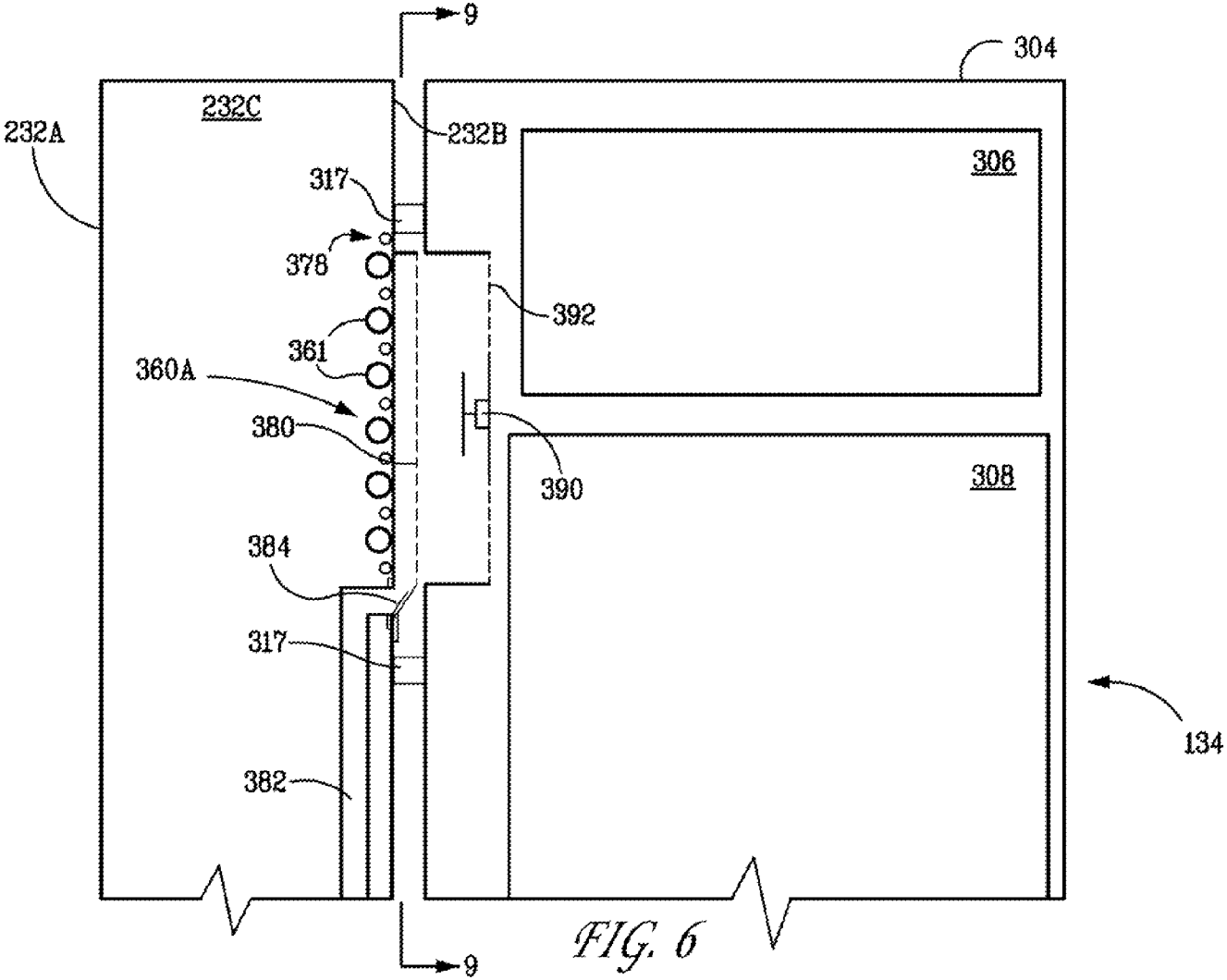
FIG. 6 is a partial, schematic view of the heat exchanger and the sub-compartment of the refrigerator of FIG. 2 with the fresh food compartment door being closed.
Figure 7:
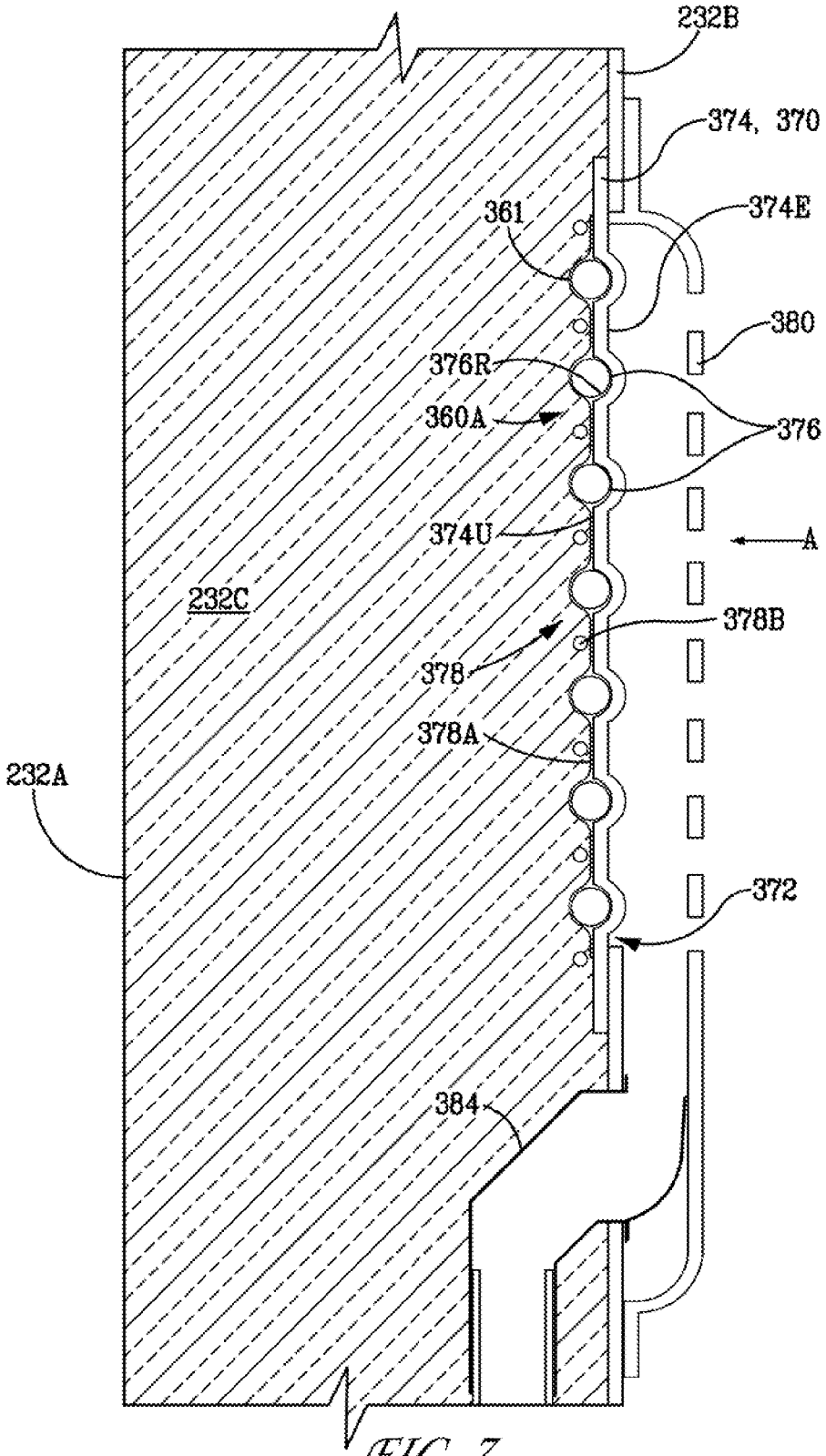
FIG. 7 is an enlarged, schematic view of the heat exchanger of FIG. 6.

Referring still to FIGS. 1-7 preferably, the portion 360A of the fluid connection loop 360 has a plurality of bent sections 361. The heat-exchanging plate 374 preferably has a plurality of projections 376 which extend outward from its first, exposed surface 374E. Preferably, each of the projections 376 has a curved cross-section (substantially semi-spherical cross sections are shown in FIG. 7) so that the projections 376 also define receiving channels 376R on the second, unexposed, foam-facing surface 374U of the heat-exchanging plate 374 for receiving the respective bent sections 361. Such projections 376 enhance not only the heat exchange between the bent sections 361 and the heat-exchanging plate 374, but also the heat exchange between the heat-exchanging plate 374 and the air in the sub-compartment 304.

Figure 8:
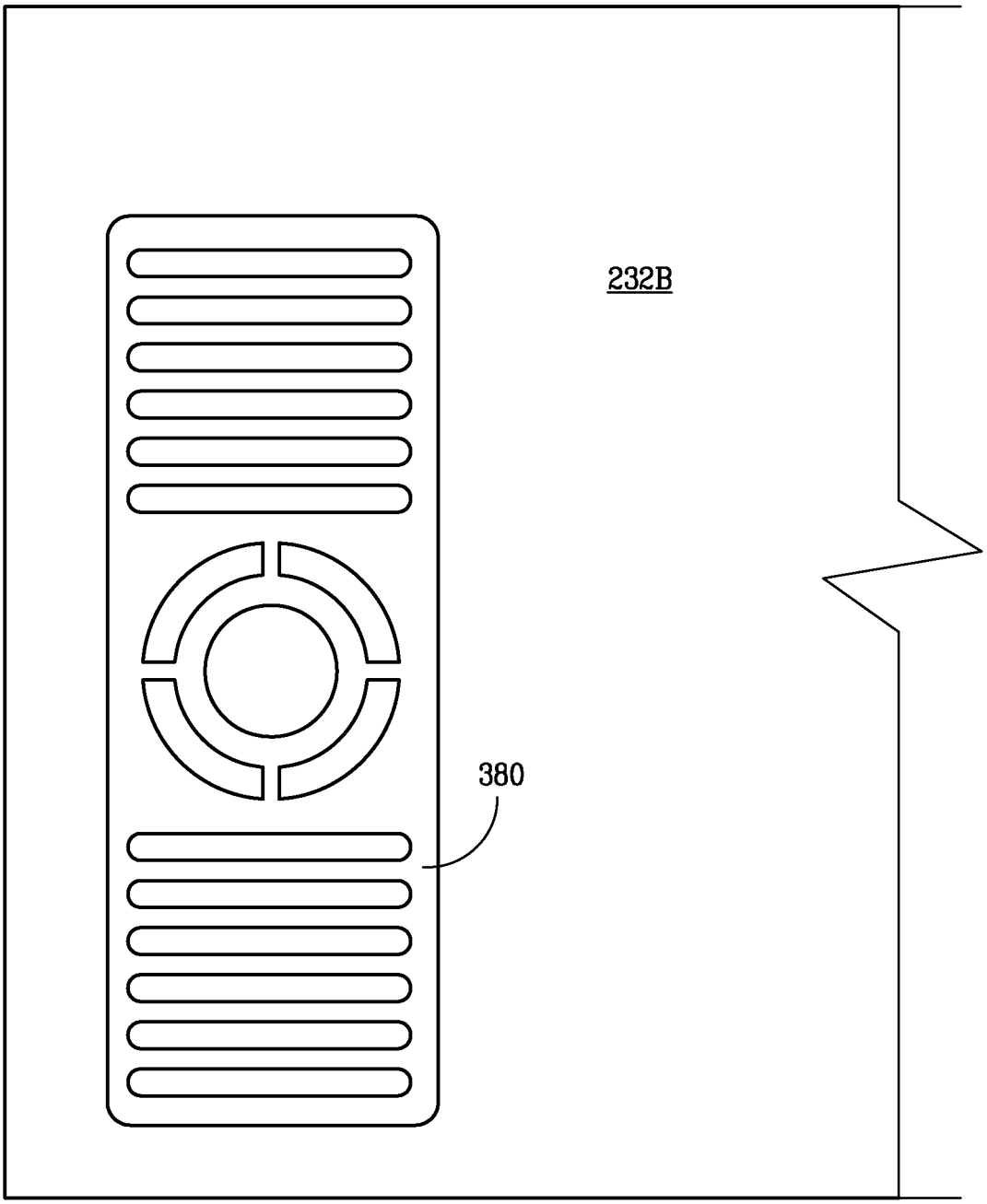
FIG. 8 is an enlarged, schematic view in the direction of arrow A in FIG. 7.

As shown in FIGS. 6-8, an appearance enhancing louvered cover 380 is preferably used to cover the heat-exchanging plate 374. The louvered cover 380, which is supported by the liner 232B, is spaced apart from the heat-exchanging plate 374.

Preferably, a defrost heater can be thermally coupled to the heat-exchanging plate 374 to remove frost that may form on the exposed surface of plate 374. In one embodiment, an aluminum foil defrost heater 378 comprising foil layer 378A and resistive heater coils 378B, (FIG.7) is used to defrost the heat-exchanging plate 374. In this embodiment, the bent sections 361 of the serpentine portion 360A are sandwiched between the heat-exchanging plate 374 and the layer of aluminum foil that overlays the foam-facing surface 374U of plate 374. A drain tube 382, preferably embedded in the sidewall, with an inlet proximate the lower end of the heat-exchanging plate 374, is provided for directing the defrost water to a drain pan (not shown) which may be the evaporator drain pan. As shown in FIG. 7, a scoop 384 is located proximate the lower ends of the heat-exchanging plate 374 and the louvered cover 380 for directing the defrost water from the heat-exchanging plate 374 and the louvered cover 380 into the drain tube 382. The scoop 384 may have a configuration that covers the entire width of the heat-exchanging plate 374 and the entire width of the louvered cover 380. Preferably the scoop 384 is made of a flexible material such as rubber of soft plastic so as to not interfere with the door foaming process.

Figure 9:
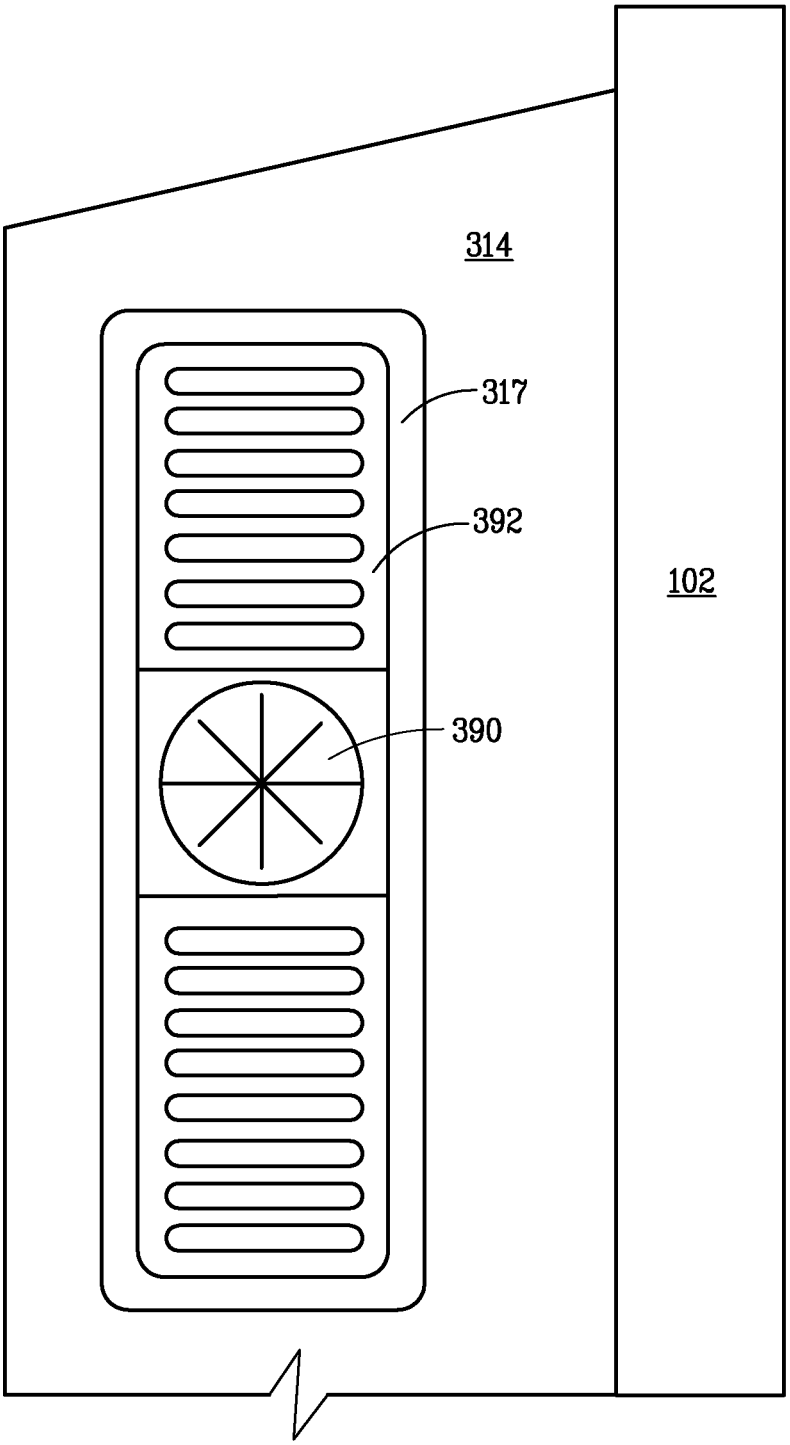
FIG. 9 is an enlarged, schematic side view of a portion of the fresh food compartment door of FIG. 6, viewed along line 9-9 in FIG. 6.

Referring now to FIGS. 5 and 6, an electric fan 390 is located in the sub-compartment 304 for facilitating the heat exchange between the air in the sub-compartment and the heat-exchanging plate 374 when the door 132 is closed. Preferably, the fan is disposed adjacent to the opening 314A. As shown in FIGS. 5,6 and 9, a louvered fan bracket 392 is preferably used to at least partially cover the opening 314A and to support the fan 390. The fan 390 directs air in an axial direction toward the exposed surface of the plate 374. As the air then moves radially over the exposed surface of the plate 374, cooled by the coolant passing through the cooling serpentine 360A, heat is absorbed by the plate 374 and the chilled air recirculates through the ice sub-compartment 304. By this arrangement, the air in the ice sub-compartment 304 is chilled sufficiently to form ice in the icemaker.

The icemaker 306, the defrost heater 378 and the fan 390 may be powered by a common power source or by a dedicated power source of their own.

Thus, while there have shown and described and pointed out fundamental novel features of the invention as applied to various specific embodiments thereof, it will be understood that various omissions and substitutions and changes in the form and details of the devices illustrated, and in their operation, may be made by those skilled in the art without departing from the spirit of the invention. For example, the gasket 317 may be attached to the sidewall 232S instead.

Figure 15:
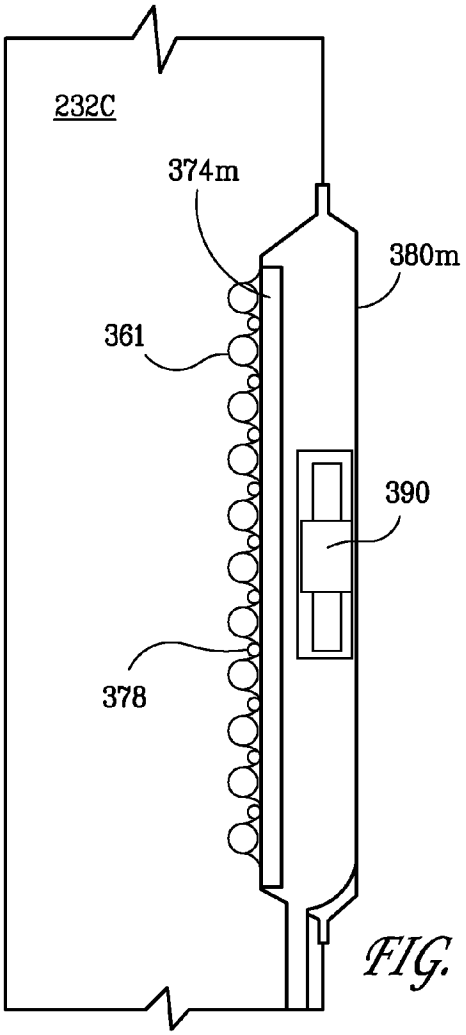
FIGS. 14 and 15 schematically show a heat exchanger in accordance with a fifth exemplary embodiment of the invention and its modified cover.
Figure 14:
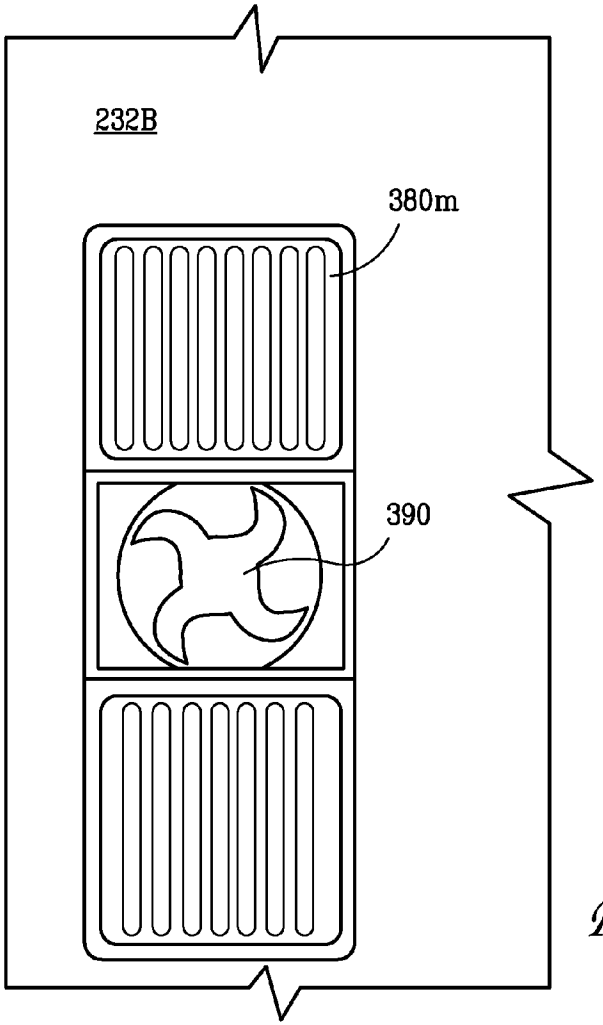

Additionally, the heat-exchanging plate 374 can have different configurations. For instance, FIGS. 10 and 11 show a modified heat-exchanging plate 374', which has a plurality of short projections 376S and a plurality of long projections 376L, all projecting or extending outward from the exposed surface 374E'. The heat-exchanging plate 374' also has a plurality of projections 376B extending outward from the un-exposed surface 374U'. Each of the projections 376B forms a receiving channel 376R' for receiving a respective bent section 361. (FIG.7). FIG. 12 shows another modified heat-exchanging plate 374" which has essentially flat surfaces without any projections. The heat-exchanging plate 374" can be attached to the inner side of the liner 232B" which has no opening 372. In this configuration, the heat-exchanging plate 374" and at least part of the liner 232B" attached to the heat-exchanging plate 374" can be considered to form the heat exchanger 370" because both become cold when the refrigerant passes through the serpentine portion 360A. FIG. 13 shows yet another modified heat-exchanging plate 374'", which has fin-shaped projections 376''' extending outward from its exposed surface 374E" and projections that are similar to those shown in FIGS. 10 and 11 that extend outward from its un-exposed surface 374U'''. FIG. 15 schematically shows yet another modified heat-exchanging plate 374*m* and its louvered cover 380*m*. As clearly illustrated in FIGS. 14 and 15, in this embodiment, the fan 390 is supported in the case side wall 232, by the louvered cover 380*m*, and preferably disposed between the louvered cover 380*m* and the heat-exchanging plate 374*m*.

Figure 16:
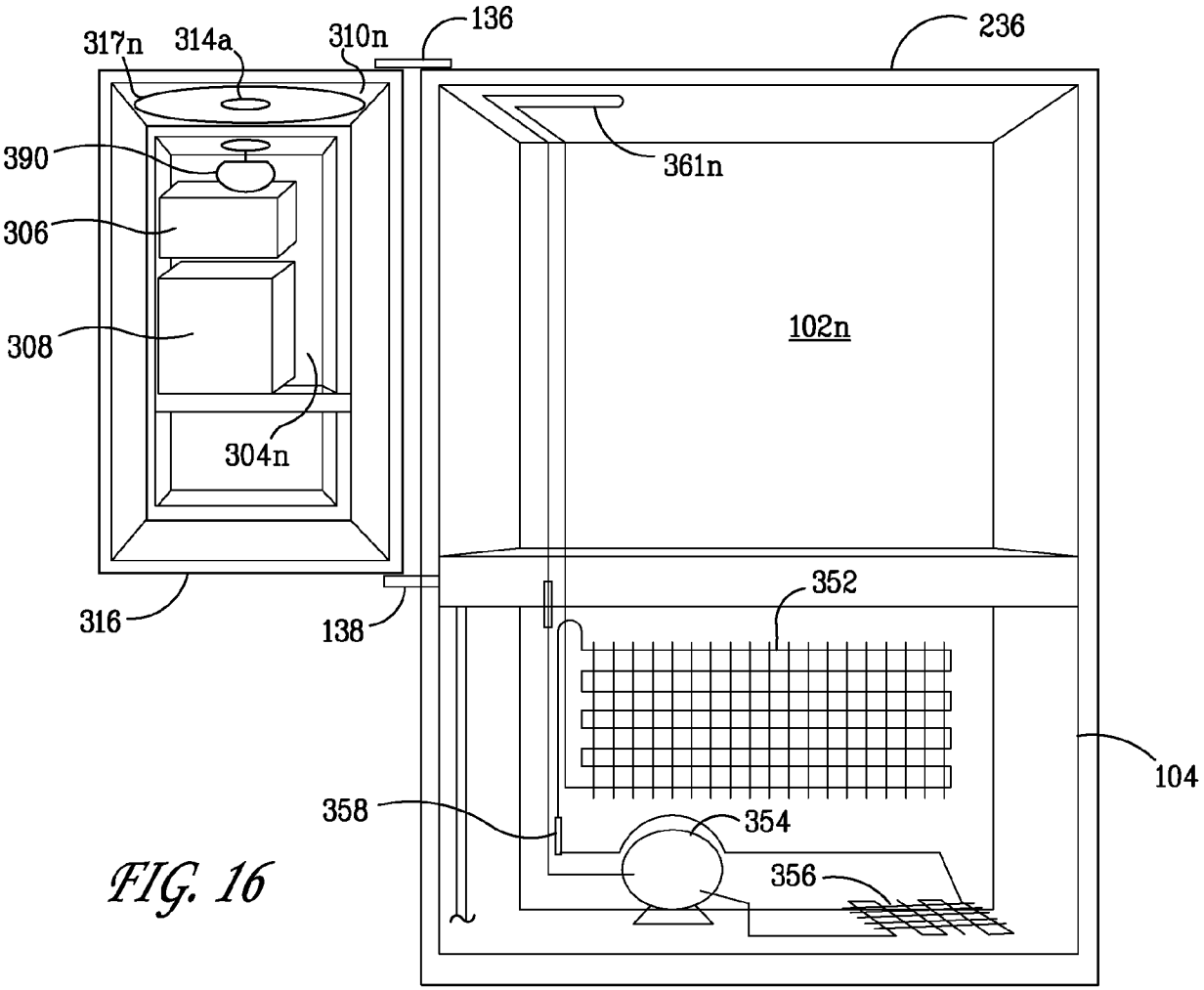
FIG. 16 is similar to FIG. 3, illustrating an alternative embodiment in which the heat exchanger is located above the fresh food compartment door.

Furthermore, the locations of the heat exchanger 370, the bent sections 361 and the opening 314A can be changed. The bent sections 361 and the heat exchanger 370 can be on any of the walls of the fresh food compartment 102. FIG. 16 shows that the bent sections 361*n* are supported by the top wall 236 of the fresh food compartment 102*n*. The heat exchanger (not shown in FIG. 16) is supported by the top wall 236 as well, and the opening 314A is formed on the top wall 310*n* of the sub-compartment 304*n*. The gasket 317*n* is mounted on the top wall 310*n*. Of course, the gasket 317*n* can be mounted on the top wall 236 of the fresh food compartment 102*n* instead. The fan 390 is shown disposed in the sub-compartment 304*n*. As discussed earlier, it can be supported by either the louvered cover (not shown in FIG. 16) for the heat exchanger or the louvered fan bracket (not shown in FIG. 16).

Moreover, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A refrigerator comprising:

a main body defining a compartment, the compartment having an access opening, a first wall and a heat exchanger supported by the first wall;

a refrigeration system containing therein a working medium, the refrigeration system comprising an evaporator disposed outside of the compartment for cooling the compartment, a condenser, and a fluid connection for circulating the working medium, the fluid connection comprising bent sections which are disposed between the evaporator and the condenser and are thermally coupled to the heat exchanger so that when passing through the bent sections, the working medium cools the heat exchanger;

a door supported by the main body for selectively closing at least part of the access opening of the compartment;

a sub-compartment on the door, the sub-compartment comprising a second wall having an opening; and an icemaker disposed in the sub-compartment, wherein the heat exchanger and the second wall are positioned so that when the door is in a closed position, the heat exchanger is exposed to an interior of the sub-compartment through the opening, wherein the heat exchanger is spaced apart from and has no direct contact with the icemaker when the door is in the closed position to convectively cool the icemaker, and wherein the heat exchanger comprises a heat-exchanging plate comprising a first surface facing the second wall when one of the doors is in the closed position and a second surface opposite the first surface, the second surface forming a plurality of receiving channels for receiving the respective bent sections.

2. The refrigerator of claim 1, further comprising a gasket supported by one of the first wall and the second wall, wherein when the door is in the closed position, the gasket substantially sealingly surrounds the heat exchanger and the opening.

3. The refrigerator of claim 1, wherein the bent sections are directly connected to the heat exchanger.

4. The refrigerator of claim 3, further comprising a fan disposed between the heat exchanger and the icemaker when the door is in the closed position for facilitating heat exchange between air in the interior of the sub-compartment and the heat exchanger.

5. The refrigerator of claim 1, wherein the plurality of receiving channels are substantially semi-spherical in cross-section.

6. A refrigerator comprising:

a main body defining a first compartment and a second compartment, the first compartment having an access opening, a first wall and a heat exchanger supported by the first wall;

a refrigeration system containing therein a working medium, the refrigeration system comprising an evaporator which is disposed in the second compartment for cooling the first compartment and the second compartment, a condenser, and a fluid connection for transferring the working medium from the evaporator to the condenser, the fluid connection comprising bent sections which are disposed between the evaporator and the condenser and are thermally coupled to the heat exchanger so that when passing through the bent sections, the working medium cools the heat exchanger;

a door supported by the main body for selectively closing at least part of the access opening of the first compartment;

a sub-compartment on the door, the sub-compartment having a second wall having an opening; and an icemaker disposed in the sub-compartment, wherein the heat exchanger and the second wall are positioned so that when the door is in a closed position, the heat exchanger is exposed to an interior of the sub-compartment through the opening, wherein the heat exchanger is spaced apart from and has no direct contact with the icemaker when the door is in the closed position to convectively cool the icemaker, and wherein the heat exchanger comprises a heat-exchanging plate comprising a first surface facing the second wall when one of the doors is in the closed position and a second surface opposite the first surface, the second surface forming a plurality of receiving channels for receiving the respective bent sections.

7. The refrigerator of claim 6, further comprising a gasket supported by one of the first wall and the second wall, wherein when the door is in the closed position, the gasket substantially sealingly surrounds the heat exchanger and the opening.

8. The refrigerator of claim 6, further comprising a fan for facilitating heat exchange between air in the interior of the sub-compartment and the heat exchanger.

9. The refrigerator of claim 8, wherein the first compartment further has a louvered cover which covers the heat exchanger and supports the fan.

10. The refrigerator of claim 8, wherein the sub-compartment further has a louvered fan bracket which covers the opening and on which the fan is mounted.

11. The refrigerator of claim 6, wherein the bent sections are directly connected to the heat-exchanging plate.

12. The refrigerator of claim 11, wherein the bent sections are attached to the second surface.

13. The refrigerator of claim 6, further comprising a defrost heater thermally coupled to the heat-exchanging plate.

14. The refrigerator of claim 13, wherein the main body further comprises a drain tube for directing defrost water away from the heat-exchanging plate.

15. The refrigerator of claim 6, wherein the plurality of receiving channels are substantially semi-spherical in cross-section.

16. A refrigerator comprising:

a main body defining an upper compartment and a lower compartment, the upper compartment having a frontal access, a first sidewall and a heat-exchanging plate supported by the first sidewall;

a refrigeration system containing therein a refrigerant, the refrigeration system comprising an evaporator which is disposed in the lower compartment for cooling the upper compartment and the lower compartment, a condenser, and a fluid connection for transferring the refrigerant from the evaporator to the condenser, the fluid connection comprising bent sections which are disposed between the evaporator and the condenser and are thermally coupled to the heat-exchanging plate so that when passing through the bent sections, the refrigerant cools the heat-exchanging plate;

a pair of doors supported by the main body for selectively closing the frontal access of the upper compartment;

a sub-compartment on one of the doors and substantially disposed in the upper compartment when the one of the doors is in a closed position, the sub-compartment comprising a second sidewall having an opening; and an icemaker disposed in the sub-compartment, wherein the heat-exchanging plate is coolable by the refrigerant, wherein the heat-exchanging plate and the second wall are positioned so that when the one of the doors is in the closed position, the heat-exchanging plate is exposed to an interior of the sub-compartment through the opening, wherein the heat-exchanging plate is spaced apart from and has no direct contact with the icemaker when the one of the doors is in the closed position to convectively cool the icemaker, and wherein the heat-exchanging plate comprises a first surface facing the second sidewall when one of the doors is in the closed position and a second surface opposite the first surface, the second surface forming a plurality of receiving channels for receiving the respective bent sections.

17. The refrigerator of claim 16, wherein the heat-exchange plate comprises a metal plate.

18. The refrigerator of claim 17, wherein the upper compartment is a fresh food compartment.

19. The refrigerator of claim 18, wherein the lower compartment is a freezer compartment.

20. The refrigerator of claim 16, wherein the bent sections are directly connected to the heat-exchanging plate.

21. The refrigerator of claim 20, wherein a plurality of projections extend outward from the first surface.

22. The refrigerator of claim 21, wherein the projections comprise first projections and second projections which project further away from the first surface than the first projections.

23. The refrigerator of claim 21, wherein the projections comprise fins.

24. The refrigerator of claim 16, further comprising a foil defrost heater which overlays the bent portions to the second surface.

25. The refrigerator of claim 24, wherein the heat-exchanging plate further comprises a lower end, the refrigerator further comprising a drain tube operatively connected to the lower end of the heat-exchanging plate for directing defrost water away from the heat-exchanging plate.

26. The refrigerator of claim 16, wherein the sub-compartment further comprises a gasket surrounding the opening, and wherein when the one of the doors is in the closed position, the gasket touches the first sidewall to substantially sealingly surround the heat-exchanging plate.

27. The refrigerator of claim 16, further comprising a fan for facilitating heat exchange between air in the interior of the sub-compartment and the heat-exchanging plate.

28. The refrigerator of claim 27, wherein the sub-compartment further has a louvered fan bracket which covers the opening and on which the fan is mounted.

29. The refrigerator of claim 27, wherein the upper compartment further has a louvered cover which is spaced from and covers the heat-exchanging plate.

30. The refrigerator of claim 29, wherein the fan is mounted on the louvered cover.

31. The refrigerator of claim 16, wherein the plurality of receiving channels are substantially semi-spherical in cross-section.

* * * * *